United States Patent [19]

Virr

[11] Patent Number: 5,070,821

[45] Date of Patent: Dec. 10, 1991

[54] ROTARY FLUID BED GASIFIER FOR BOILERS OR FURNACES

[76] Inventor: Michael J. Virr, 1222 Bronson Rd., Fairfield, Conn. 06430

[21] Appl. No.: 548,006

[22] Filed: Jul. 5, 1990

[51] Int. Cl.[5] ..... F22D 1/00

[52] U.S. Cl. ..... 122/7 K; 110/226; 110/229; 110/245; 110/246; 122/4 D

[58] Field of Search ..... 122/7 R, 11, 4 D; 110/245, 246, 226, 229; 431/7; 48/61

[56] References Cited

U.S. PATENT DOCUMENTS

| | | | |
|---|---|---|---|
| 4,006,024 | 1/1978 | O'Connor | 110/245 |
| 4,282,009 | 8/1981 | Belke et al. | 122/11 X |
| 4,539,939 | 9/1985 | Johnson | 122/4 D |
| 4,741,290 | 5/1988 | Krieger et al. | 122/4 D |

*Primary Examiner*—Edward G. Favors

*Attorney, Agent, or Firm*—Ailes, Ohlandt & Greeley

[57] ABSTRACT

A rotary fluid bed gasifier which comprises: a rotatable drum having a circumferentially extending wall which is permeable to gases; a means for feeding a fluidizing gas through the wall into the drum; a bed of particles which, at least when the gasifier is in use, is supported on an internal face of the wall and is fluidized by the fluidizing gas; an outlet means for receiving a carbonaceous material from outside the gasifier and delivering the carbonaceous material to the drum; a means for introducing steam into the drum; a de-$NO_x$ boiler having a quench zone and a nitrogen fixing zone; a means for introducing secondary air disposed between the quench zone and the nitrogen fixing zone; and a means for introducing tertiary air disposed between the de-$NO_x$ boiler and a main boiler or furnace.

20 Claims, 3 Drawing Sheets

ROTARY FLUID BED GASIFIER FOR BOILERS OR FURNACES

The present invention relates to a novel rotary fluid bed gasifier which is affixed to the boiler of a power station wherein coal is gasified and combusted efficiently to produce steam or to a heat treatment furnace with reduced $SO_x$ and $NO_x$ emissions.

BACKGROUND OF THE INVENTION

Due to the high cost of oil and the inherent dangers associated with nuclear energy, engineers and scientists are again turning to coal as an inexpensive and readily available source of energy. Coal is burned to generate heat which is captured as steam in packaged boilers. The steam is either used to power a turbine which turns a generator and produces electricity or used in industrial process applications. Unfortunately, the burning of coal produces $SO_x$ and $NO_x$ which is extremely hazardous to the environment.

Conventional coal boilers are equipped with pulverized coal dispersion burners. Referring to FIG. 3 attached hereto, burners 1, 2, and 3 receive coal from coal bunker 4 and classifier 5. The coal is first pulverized into fine particles by a crusher or mill 6 which is powered by motor 18. The fine coal particles are delivered to the burners (1,2,3) by means of conduit 7 which includes coal fan 8 and coal valve 9. Combustion air is delivered to the burners (1,2,3) via forced draft fan or blower 10. The fine coal particles are propelled from the burners (1,2,3) into combustion chamber 11, wherein the coal is burned and the heat generated therefrom is used to produce steam. Substantial heat transfer occurs at platen 12 and superheater 13. Thereafter, the flue gases pass through economizer 14, wet scrubber 15 and stack 16. The flue gases which exit wet scrubber 15 are directed to stack 16 via induced draft fan or blower 17.

The burners used in conventional pulverized coal boilers are inefficient insofar as they use a lot of power, require expensive coal pulverization, necessitate the application of expensive wet scrubbers to reduce $SO_x$ emissions, and produce flue gases with undesirably high $NO_x$ levels. Furthermore, $NO_x$ levels are typically reduced via selective catalytic reduction by injecting ammonium or urea, but ammonia may occur and the additive solutions are expensive.

In an effort to overcome the above-mentioned disadvantages of conventional pulverized coal burners and to provide a more environmentally acceptable means for producing energy from coal, the present inventor has investigated the use of rotating fluid bed combustors as burners in coal fired boiler applications.

Early research on rotating fluid bed combustors is set forth in U.S. Pat. No. 4,039,272 (Elliot), which issued Aug. 2, 1977, and articles by C. I. Metcalfe and J. R. Howard, "Fluidisation and Gas Combustion in a Rotating Fluidised Bed", *Applied Energy,* Applied Science Publishers Ltd., Vol. 3, (1977), pp. 65-73, and J. Broughton and D. E. Elliott, "Heat Transfer and combustion in Centrifugal Fluidized Beds", *I.Chem. E. Symposium Series No.* 43, pp. 11-1 to 11-6.

All of the aforementioned rotary fluidized bed combustors were directed to combustion of coal in drums which rotated about their vertical axis so as to form,-,substantially vertical beds. U.S. Pat. No. 4,039,272 (Elliott) discloses an apparatus for carrying out a reaction in a fluidized bed comprising a rotatable drum with a circumferential wall which is permeable to gases. A bed of particles is supported on the circumferential wall of the rotating drum during operation and the reactants are fed into the bed. A fluidizing gas is passed through the circumferential wall of the drum. A receiver is provided to retain small particles carried from the bed by the fluidizing gas. The small particles are returned to the bed when operation ceases. A reservoir for discharging larger particles into the bed after operation has commenced may be provided.

When the drum is rotated, the particles of which the bed is composed tend to move away from the axis of rotation towards the circumferential Wall. If the fluidizing gases are admitted to the bed through the circumferential Wall, the centrifugal action opposes the action of the gases on the particles and, provided the drum is rotated at a sufficiently high speed, the particles will not be blown completely away from the circumferential wall be fluidizing gases entering the bed at high speed. Variable speed drive means may be provided for rotating the drum. This arrangement enables the apparatus to operate satisfactorily with widely different rates of supply of combustible material and oxidant.

The apparatus according to the Elliott patent may also be used for gasification of coal, in which case air would be fed into the drum at a rate lower than that necessary to provide for complete combustion of the fuel. Gases leaving the drum through the outlet would then contain combustible gases.

The Metcalfe et al. article proposed that fuel flow rates in conventional fluidized bed combustors are limited by the maximum fluidization velocity at which the bed can operate without particles being elutriated from the bed; whereas a rotating fluidized bed combustor would allow the operating range to be extended by imposing a high centripetal acceleration on the particles which allows the bed to operate with higher fluidization velocities.

The Broughton article proposed that combustion intensity can be accomplished by means of rotating a cylindrical bed about its axis thus providing a centrifugal field which allows the fluidizing velocity for a given particle size to be increased more or less in proportion to the number of gravities imposed.

The aforementioned references disclose only vertically disposed rotary fluid bed combustors. The present inventor has developed a novel rotary fluid bed gasifier for use as novel burners attached to a boiler or furnace. This burner is extremely efficient and produces far less environmentally hazardous emissions then conventional burners.

Additional advantages of the present invention shall become apparent as described below.

SUMMARY OF THE INVENTION

A rotary fluid bed gasifier which comprises: a rotatable drum having a circumferentially extending wall which is permeable to gases; a means for feeding a fluidizing gas through the wall into the drum; a bed of particles which, at least when the gasifier is in use, is supported on an internal face of the wall and is fluidized by the fluidizing gas; an outlet means for receiving a carbonaceous material from outside the gasifier and delivering the carbonaceous material to the drum; a means for introducing steam into the drum; a de-$NO_x$ boiler having a quench zone and a nitrogen fixing zone; a means for introducing secondary air disposed between the quench zone and the nitrogen fixing zone; and a means for introducing tertiary air disposed between the de$NO_x$ boiler and a main boiler or furnace.

An additional object of the present invention is a system for producing steam from the combustion of a carbonaceous material which comprises: a rotary fluid bed gasifier; a boiler; a superheater; an economizer; a baghouse; and a stack.

A further object of the present invention is a method of producing steam from the combustion of a carbonaceous material in a rotary fluid bed gasifier comprising the steps of: introducing a fluidizing gas and a combustible gas into the drum wherein bed particles are fluidized; igniting the combustible gas within a drum of the rotary fluid bed gasifier; heating the bed particles to approximately 1000° F.; introducing a carbonaceous material to the drum; removing the combustible gas; introducing steam into the drum; controlling the temperature within the drum to between about 1600°-1800° F. by adjusting the flow rate of the fluidizing gas and steam, the speed of the drum, and the rate of introduction of the carbonaceous material; and introducing the secondary air and tertiary air into a de-$NO_x$ boiler of the rotary fluid bed gasifier. The fluidizing gas is preferably fed into the drum at a rate lower than that necessary to provide for complete combustion of the carbonaceous material so as to produce a low Btu gas.

A further object of the present invention is a method for gasifying a carbonaceous material using the rotary fluid bed gasifier according to the present invention.

Other and further objects, advantages and features of the present invention will be understood by reference to the following specification in conjunction with the annexed drawings, wherein like parts have been given like numbers.

DESCRIPTION OF THE PREFERRED EMBODIMENTS

The rotary fluid bed gasifier is a shallow fluid bed which is supported on the circumference of a rotary drum which holds the bed in position. This results in the ability to achieve high 'g' forces in the bed which in turn makes possible the use of higher velocities than are possible with 1 'g' beds. In this manner a gasifier may be operated at velocities up to 20 ft/sec at combustion intensities of $3.2\times10^6$ Btu/ft$^3$/hr at atmospheric pressure. However, the rotary fluid bed gasifier of the present invention is operated at about one quarter to one half of this as it is only required to produce low Btu gas. The gasifier is fueled with a carbonaceous material, such as light gas oil, gas or coal.

Figure 1:
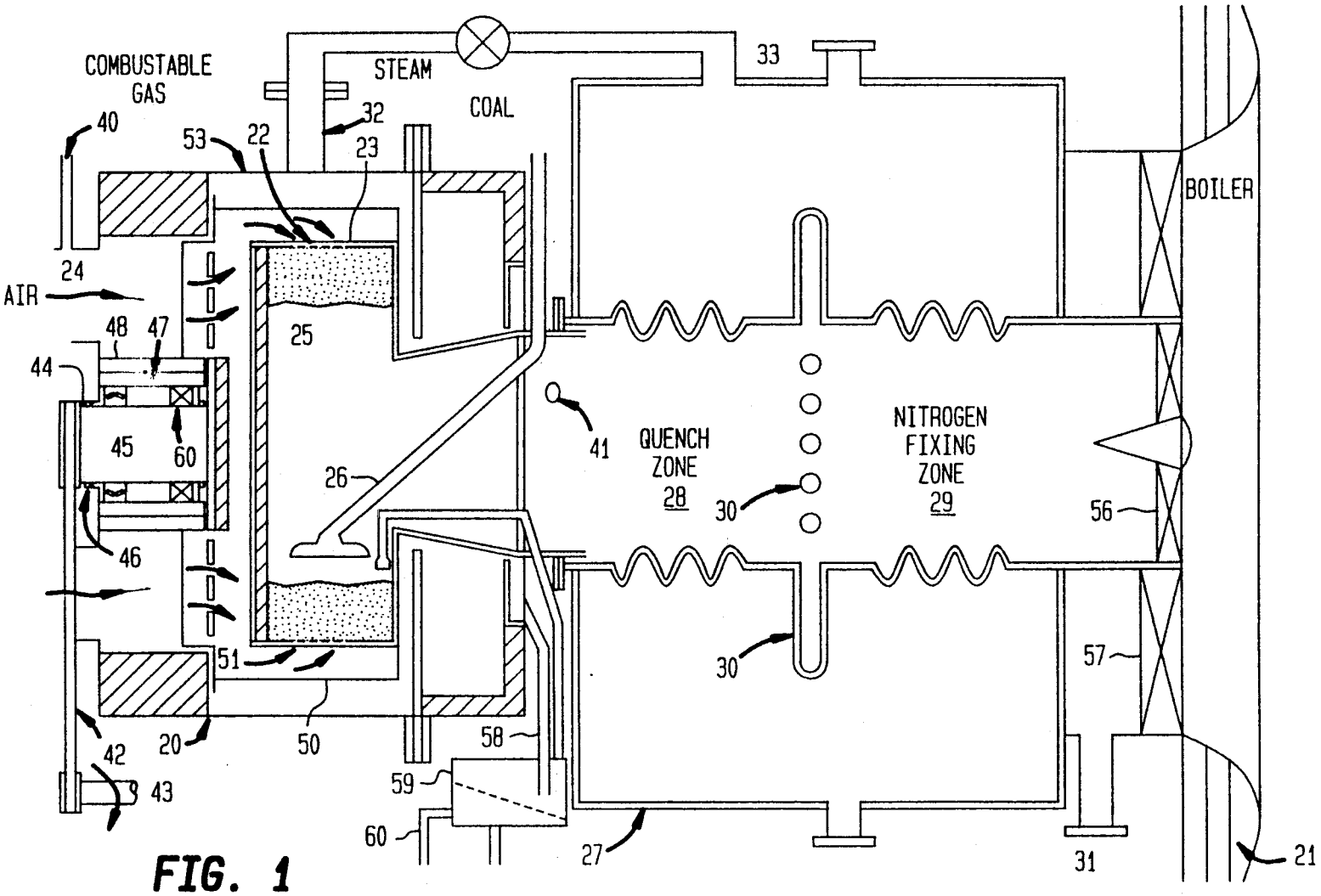
FIG. 1 is a schematic representation illustrating a rotary fluid bed gasifier in accordance with the present invention.

The present invention can best be described by referring to the attached drawings, wherein FIG. 1 is a schematic representation of the novel rotary fluid bed gasifier. The rotary fluid bed gasifier 20 is bolted to a wall of boiler 21. Rotary fluid bed gasifier 20 comprises: a rotatable drum 22 having a circumferentially extending wall 23 which is permeable to gases; feed means 24 for feeding a fluidizing gas, e.g., air or a combination of air and a combustible gas, through wall 23 into drum 22; a bed of particles 25 which, at least when gasifier 20 is in use, is supported on an internal face of wall 23 and is fluidized by the fluidizing gas; an outlet means 26 for receiving a carbonaceous material from outside gasifier 20 and delivering the carbonaceous material to drum 22; a de-$NO_x$ boiler 27 having a quench zone 28 and a nitrogen fixing zone 29; a means 30 for introducing secondary air disposed between quench zone 28 and nitrogen fixing zone 29; and a means 31 for introducing tertiary air disposed between de-$NO_x$ boiler 27 and main boiler or furnace 21.

Gasifier 20 also includes a means 32 for introducing steam into drum 22. The steam is obtained from conduit 33 of de-$NO_x$ boiler 27. The steam together with a fluidizing gas comprising approximately 10-80% stoichiometric air produces a reducing condition in drum 22. Outlet means 26 may simultaneously be used for receiving limestone, in addition to coal, from outside gasifier 20 and delivering the limestone to drum 22.

Gasifier 20 is positioned horizontally such that drum 22 rotates about its horizontal axis causing a horizontally sloping particle bed 25 within drum 22.

The present invention also includes a method of producing steam from the combustion of a carbonaceous material in rotary fluid bed gasifier 20 comprising the steps of: introducing a fluidizing gas and a combustible gas via conduits 24 and 40, respectively, into drum 22 wherein bed particles 25, e.g., sand, are fluidized; igniting the combustible gas within drum 22 by light-up burner 41; heating bed particles 25 to approximately 1000° F.; introducing a carbonaceous material to drum 22 via coal chute 26; removing combustible gas by shutting off its supply via conduit 40; introducing steam into drum 22 via steam conduit 32; controlling the temperature within drum 22 to between about 1600-1800° F. by adjusting the flow rate of the fluidizing gas and the steam, the speed of drum 22, and the rate of introduction of carbonaceous material; and introducing secondary air via air nozzles 30 and tertiary air via conduit 31. The fluidizing gas is preferably fed into drum 22 at a rate lower than that necessary to provide for complete combustion of the carbonaceous material so as to produce a low Btu gas.

Drum 22 is rotated by shaft 44 and drive belt 42 driven by motor 43. Shaft 44 includes a post 45, oil seals 46, inner shell 47, outer shell 48 and bearings 60. Shaft 44 is connected to a distributor plate 49 of rotatable housing 50. Housing 50 is connected to drum 22 is such a manner as to provide a conduit 51 between housing 50 and circumferentially extending wall 23 so that fluidizing gas from conduit 24 may enter housing 50 via distributor plate 49 and thereafter pass into drum 22 via conduit 51 and circumferentially extending wall 23. A conduit 52 is provided between rotatable housing 50 and combustor housing 53 such that steam from conduit 32 may traverse conduits 52 and 51, and thereafter enter drum 22 via wall 23. Rotatable housing 50 is rotatably disposed between combustor housing 53 and de-$NO_x$ boiler 27 which remain stationary during normal operation. Drum 22 preferably rotates at a speed in the range between about 50 rpm to about 1000 rpm.

Subsequent to starting up gasifier 20, coal is continuously fed via coal chute 26 into drum 22. Drum 22 is maintained at a temperature of approximately 1600°-800° F. which provides a reducing environment and generates a hot low Btu gas, i.e., 100-160 Btu/ft$^3$.

The resultant gas exits drum 22 and enters quench zone 28 of de-$NO_x$ boiler 27 where the temperature of the gas is lowered. After the temperature of the gas is lowered to approximately 1100–1500° F. secondary air is injected into de-$NO_x$ boiler 27 via secondary air nozzles 30. Secondary air reacts with the gas in nitrogen fixing zone 29 in accordance with the below equation:

$$4NH_3+3O_2+N_2 \rightarrow 6H_2O+3N_2$$

The low Btu gas has a temperature after passing through nitrogen fixing zone 29 of approximately 1200°–1400° F. The nitrogen fixed low Btu gas passes through an inner register 56 mounted on boiler 21. An outer register 57, also mounted on boiler 21, is arranged so that tertiary air or final combustion air from conduit 31 passes through outer register 57 and into boiler 21 to cause complete combustion of the low Btu gas emitted from gasifier 20. Since some coal ash particles escape from gasifier 20 into boiler 21, the resultant flame is luminous. Optionally, a bed material reclamation unit 59 with conduits 58 and 60 is attached to gasifier 20.

Figure 2:
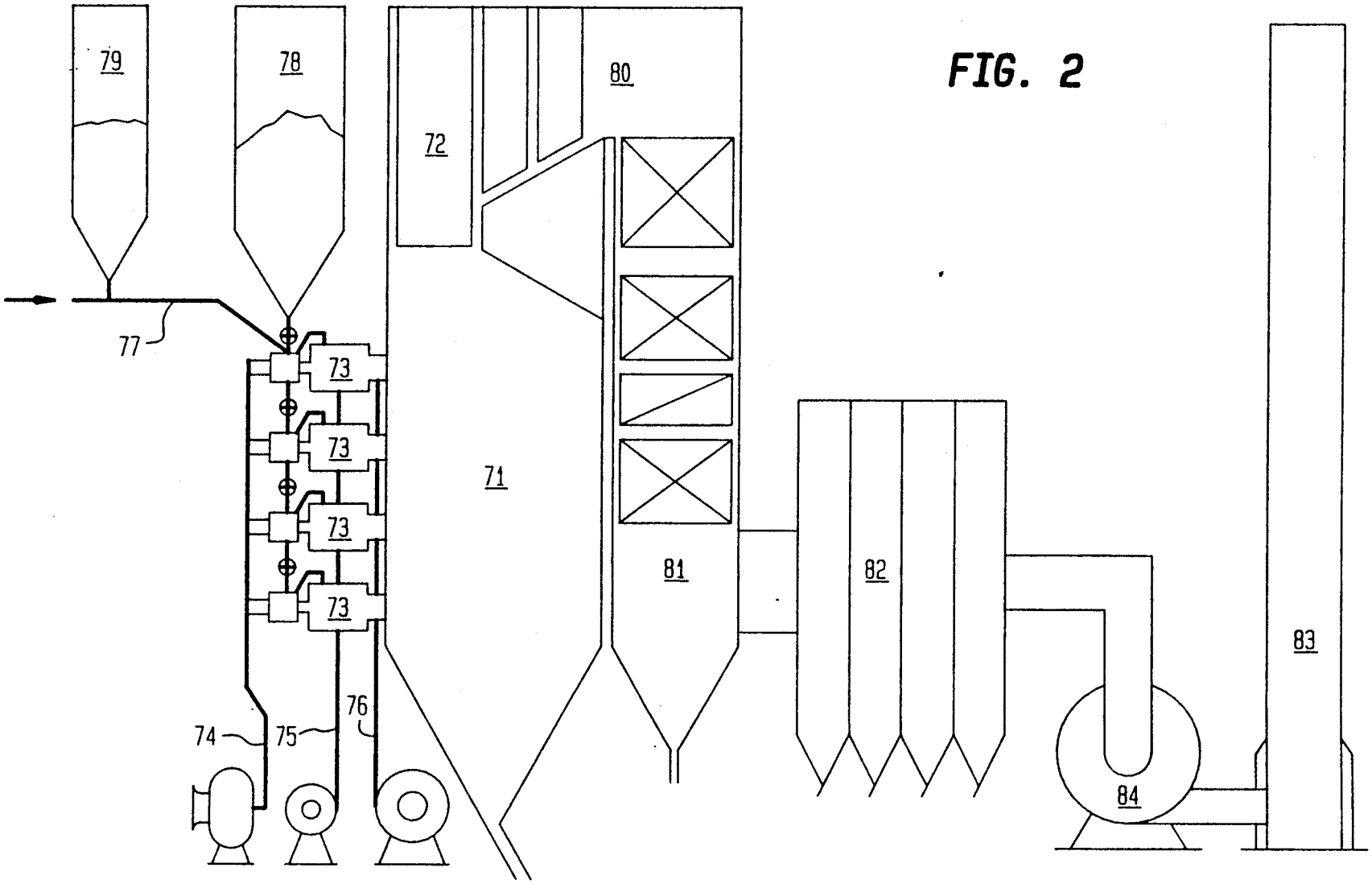
FIG. 2 is a schematic representation illustrating the application of the rotary fluid bed gasifier of the present invention in a boiler system.
Figure 3:
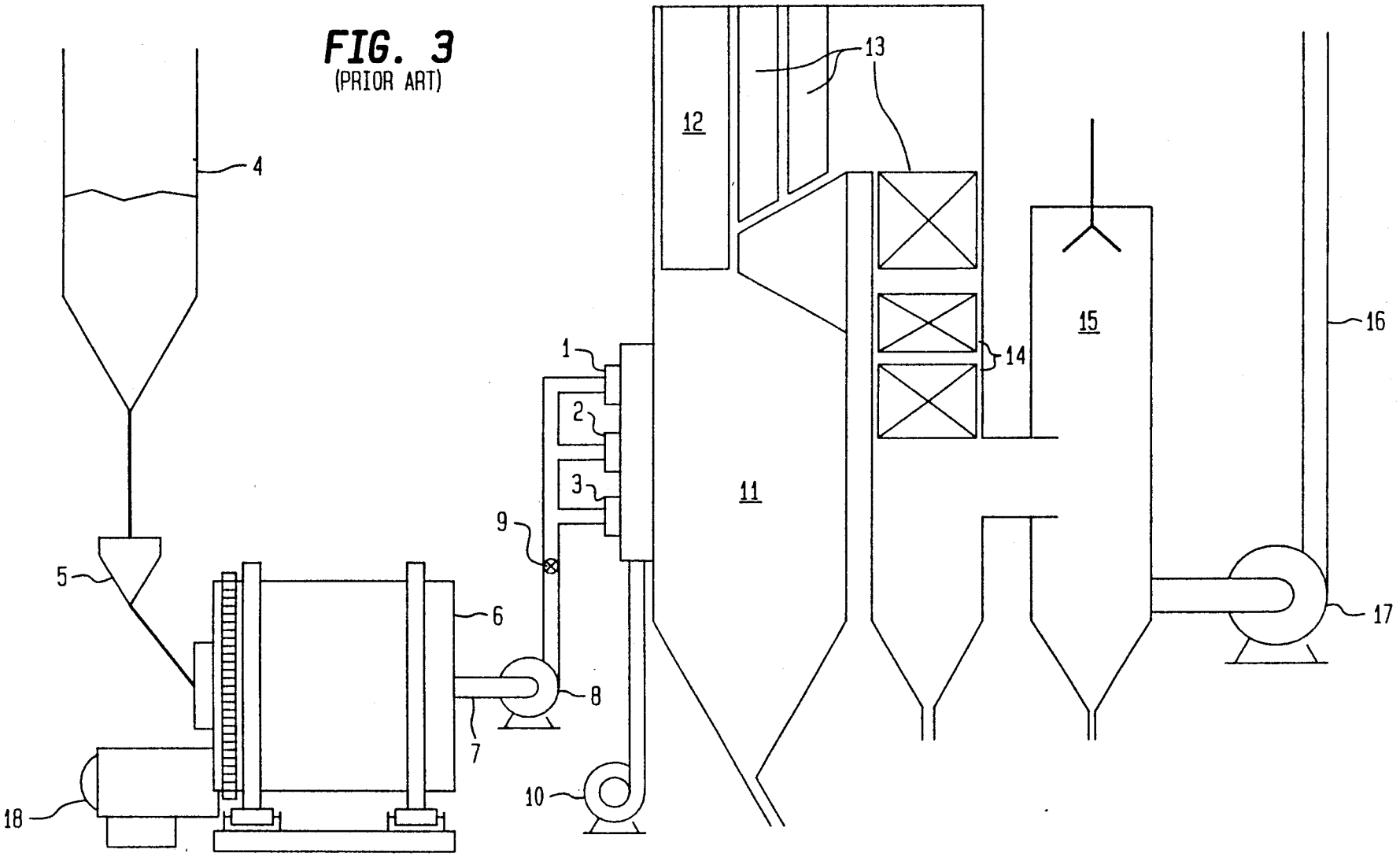
FIG. 3 (PRIOR ART)
FIG. 3 is a schematic representation illustrating the use of conventional pulverized coal burners in a boiler system.

The rotary fluid bed gasifier is typically mounted onto a conventional pulverized coal boiler. FIG. 2 is a pulverized coal boiler system having a boiler 70 with combustion chamber 71 and platens 72. Attached to the sidewall of boiler 70 at the level of combustion chamber 71 are three rotary fluid bed gasifiers 73, although it is contemplated that any number of gasifiers may be used as needed. Each gasifier 73 is connected to means for supplying a fluidizing gas 74, secondary air 75 and tertiary air 76.

During operation gasifiers 73 are heated to a temperature of approximately 1000° F. by providing a fluidizing gas 74 containing a mixture of air and a combustible gas, e.g., propane or natural gas. After attaining the desired start-up temperature coal and limestone are introduced to gasifiers 73 via conduit 77. The coal and limestone are stored in hoppers 78 and 79, respectively. Gasifiers 73 thereafter emit a luminous coal particle and low Btu gas flame into combustion chamber 71. The flame has a temperature of approximately 2200°–2400° F.

The heat generated from the flame of gasifiers 73 produces steam in heat exchange means disposed within boiler 70. The flue gas exits combustion chamber 71 via platens 72 and superheater 80. Thereafter, the flue gas passes through economizer 81 and baghouse 82, and is directed from baghouse 82 to stack 83 via blower 84. The flue gas which is emitted to the atmosphere via stack 83 typically has $SO_x$ of less than 10% and $NO_x$ of less than 25 ppm.

It is believed that the rotary fluid bed gasifier of the present invention could be installed or retrofited to conventional 50–660 megawatt pulverized coal boilers in place of conventional burners. This gasifier may also be attached to a reverberating furnace for metal melting or heat treatment.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

What is claimed is:

1. A rotary fluid bed gasifier which comprises:

a rotatable drum having a circumferentially extending wall which is permeable to gases;

a means for feeding a fluidizing gas through said wall into said drum;

a bed of particles which, at least when said gasifier is in use, is supported on an internal face of said wall and is fluidized by said fluidizing gas;

an outlet means for receiving a carbonaceous material from outside said gasifier and delivering said carbonaceous material to said drum;

a means for introducing steam into said drum;

a de-$NO_x$ boiler having a quench zone and a nitrogen fixing zone;

a means for introducing secondary air disposed between said quench zone and said nitrogen fixing zone; and a means for introducing tertiary air disposed between said de-$NO_x$ boiler and a main boiler or furnace.

2. The gasifier according to claim 1, wherein said steam is provided from said de-$NO_x$ boiler.

3. The gasifier according to claim 1, wherein said gasifier includes an outlet means for receiving limestone from outside said gasifier and delivering said limestone to said drum.

4. The gasifier according to claim 1, wherein said gasifier is positioned horizontally such that said drum rotates about its horizontal axis causing a horizontally sloping particle bed within said drum.

5. A system for producing steam from the combustion of a carbonaceous material which comprises:

a rotary fluid bed gasifier comprising: a rotatable drum having a circumferentially extending wall which is permeable to gases; a means for feeding a fluidizing gas through said wall into said drum; a bed of particles which, at least when said gasifier is in use, is supported on an internal face of said wall and is fluidized by said gas; an outlet means for receiving a carbonaceous material from outside said gasifier and delivering said carbonaceous material to said drum; a means for introducing steam into said drum; a de-$NO_x$ boiler having a quench zone and a nitrogen fixing zone; and a means for introducing secondary air disposed between said quench zone and said nitrogen fixing zone;

a main boiler, wherein a means for introducing tertiary air is disposed between said de-$NO_x$ boiler and said main boiler;

a superheater;

an economizer;

a baghouse; and a stack.

6. The system according to claim 5, wherein said steam is provided from said de-$NO_x$ boiler.

7. The system according to claim 5, wherein said gasifier includes an outlet means for receiving limestone from outside said gasifier and delivering said limestone to said drum.

8. The system according to claim 5, wherein said gasifier is positioned horizontally such that said drum rotates about its horizontal axis causing a horizontally sloping particle bed within said drum.

9. A method of producing steam from the combustion of a carbonaceous material in a rotary fluid bed gasifier comprising a rotatable drum having a circumferentially extending wall which is permeable to gases, a means for feeding a fluidizing gas through said wall into said drum, a bed of particles which, at least when said gasifier is in use, is supported on an internal face of said wall and is fluidized by said gas, an outlet means for receiving a carbonaceous material from outside said gasifier and delivering said carbonaceous material to said drum, a means for introducing steam into said drum, a de-$NO_x$ boiler having a quench zone and a nitrogen fixing zone, a means for introducing secondary air disposed between said quench zone and said nitrogen fixing zone, and a means for introducing tertiary air disposed between said de-$NO_x$ boiler and a main boiler, comprising the steps of:

introducing said fluidizing gas and a combustible gas into said drum wherein said bed particles are fluidized;

igniting said combustible gas within said drum;

heating said bed particles to approximately 100020 F.;

introducing a carbonaceous material to said drum;

removing said combustible gas;

introducing steam into said drum;

controlling the temperature within said drum to between about 600°-800° F. by adjusting the flow rate of said fluidizing gas and said steam, the speed of said drum, and the rate of introduction of said carbonaceous material; and introducing said secondary air into said de-$NO_x$ boiler and said tertiary air between said de-$NO_x$ boiler and said main boiler.

10. The method according to claim 9, wherein said drum is rotated at a speed in the range between about 50 rpm to about 1000 rpm.

11. The method according to claim 9, wherein the temperature in the quench zone is approximately 1100°-1500° F.

12. The method according to claim 9, wherein the temperature in the nitrogen fixing zone is approximately 1200°-1400° F.

13. The method according to claim 9, wherein the burning of said carbonaceous material within said drum produces a low Btu gas in an amount between about 100-160 Btu/$ft^3$.

14. The method according to claim 9, wherein said fluidizing gas is fed into said drum at a rate lower than that necessary to provide for complete combustion of said carbonaceous material so as to produce a low Btu gas.

15. The method according to claim 14, wherein said fluidizing gas is 10-80% stoichiometric air.

16. A method of gasifying a carbonaceous material in a rotary fluid bed gasifier comprising a rotatable drum having a circumferentially extending wall which is permeable to gases, a means for feeding a fluidizing gas through said wall into said drum, a bed of particles which, at least when said gasifier is in use, is supported on an internal face of said wall and is fluidized by said gas, an outlet means for receiving a carbonaceous material from outside said gasifier and delivering said carbonaceous material to said drum, and a means for introducing steam into said drum, comprising the steps of:

introducing said fluidizing gas and a combustible gas into said drum wherein said bed particles are fluidized;

igniting said combustible gas within said drum;

heating said bed particles to approximately 1000° F.;

introducing a carbonaceous material to said drum;

removing said combustible gas;

introducing steam into said drum; and controlling the temperature within said drum to between about 1600°-1800° F. by adjusting the flow rate of said fluidizing gas and said steam, the speed of said drum, and the rate of introduction of said carbonaceous material.

17. The method according to claim 16, wherein said drum is rotated at a speed in the range between about 50 rpm to about 1000 rpm.

18. The method according to claim 16, wherein the burning of said carbonaceous material within said drum produces a low Btu gas in an amount between about 100-160 Btu/$ft^3$.

19. The method according to claim 16, wherein said fluidizing gas is fed into said drum at a rate lower than that necessary to provide for complete combustion of said carbonaceous material so as to produce a low Btu gas.

20. The method according to claim 19, wherein said fluidizing gas is 10-80% stoichiometric air.

* * * * *